US006015369A

United States Patent [19]

Rasmussen

[11] Patent Number: 6,015,369

[45] Date of Patent: Jan. 18, 2000

[54] FITNESS SLED EXERCISE MACHINE

[76] Inventor: Aaron P. Rasmussen, 1776 Essex St., El Cajon, Calif. 92020

[21] Appl. No.: 09/323,283

[22] Filed: Jun. 1, 1999

Related U.S. Application Data

[63] Continuation-in-part of application No. 09/005,468, Jan. 12, 1998, abandoned.

[51] Int. Cl.[7] ..... A63B 21/068

[52] U.S. Cl. ..... 482/96; 482/97; 482/112

[58] Field of Search ..... 482/94, 95, 96, 482/98, 99, 100, 112, 102, 103, 97

[56] References Cited

U.S. PATENT DOCUMENTS

| | | | |
|---|---|---|---|
| 4,632,390 | 12/1986 | Richey | 482/96 |
| 5,334,120 | 8/1994 | Rasmussen | 482/96 |
| 5,533,953 | 7/1996 | Lui et al. | 482/96 |
| 5,549,529 | 8/1996 | Rasmussen | 482/96 |

*Primary Examiner*—John Mulcahy

[57] ABSTRACT

A fitness sled exercise machine wherein a client user may, with the cooperative force of arms and legs, elevate a body carriage or sled, tracking on a rail attached to a frame base and foldable standard, from an at rest position to a point of elevation. The user may elect a front or rear facing exercise position to accomplish the elevation task. Body weight provides the primary resistance to elevation, supplemented by additional weights and/or the resistance of a stroke adjustable hydraulic cylinder.

The specified frame standard is 90 degrees foldable for shipping, but may be locked in vertical position for operation. In the latter position, the standard supports a pulley and line lift apparatus that provides the user with an approximate 4:1 leverage advantage for upper limb manipulation of that apparatus. A system of levers and couplers serve to join the lift assembly to the sled and to foot bars located at the front and rear of the machine for lower limb participation in the elevation task.

20 Claims, 4 Drawing Sheets

FITNESS SLED EXERCISE MACHINE

CROSS-REFERENCE TO RELATED APPLICATIONS

This application is a continuation in part of prior application Ser. No. 09/005,468, filed Jan. 12, 1998, and now abandoned.

BACKGROUND OF THE INVENTION

The present invention represents an addition to a family of fitness machines that employ line and pulley mechanisms which enable an exercise client to propel a body bearing carriage, suspended on a rail like pathway, from a point of origin to a point of elevation. Body weight provides resistance to elevation and permits a return of the carriage to the point of origin. The applicant has, over a period of years, researched apparatus of this nature and has developed a variety of such machines as documented through patent history, referenced as follows: U.S. Pat. No. 5,334,120, issued Aug. 2, 1994, U.S. Pat. No. 5,549,529, issued Aug. 27, 1996, and Ser. No. 09/005,468, filed Jan. 12, 1998.

A current prototype, that relied on the above cited patented material, was demonstrated for direct marketing groups to illicit suggestions for product improvement.

The major suggestions for improvement centered around cost reduction and safety. Recommended was structural simplification to reduce manufacturing costs, with a foldable frame for shipping savings. Also suggested was reduced carriage travel with guard panels to shield working parts. The new invention represents an attempt to reconcile the positive attributes and exercise options of previous machines with the identified cost and safety considerations requisite to marketing.

SUMMARY OF THE INVENTION

The fitness sled exercise machine is a biomechanical apparatus used by an exercise client for aerobic exercise and strength conditioning. It includes frame members which support a rail that directs and contains the reciprocal travel of a body carriage, hereafter referred to as a sled. Machine motion is cyclical, beginning at a point of origin, rising to a point of elevation, and returning to its point of departure. A client user employs arm and leg motion to elevate the sled against controlled gravity and adjustable hydraulic resistance force. A system of levers, pulleys and lines function to convert bodily force to machine motion. User participation in sled elevation is accommodated in either a front facing or rear facing exercise position. Specific objects of the invention follow.

One object of the invention was to develop a space saving, foldable frame that would support the operative functions of the machine in such a manner as to reduce shipping costs.

Another object of the invention was to provide a body sled and a simple sled tracking mechanism that would function below the foldable section of the frame.

Another object of the invention was to construct a line and pulley leverage system that would minimize sled travel and maximize line payout at a ratio of approximately 1:4.

Another object of the invention was to produce apparatus capable of transmitting leg forces to assist sled elevation, and to couple that apparatus with the line and pulley leveraging system.

Another object of the invention was to provide the sled with structure that would enable the user to employ hydraulics and variable sled weightedness, to supplement body weight as the sole factor for determining resistance to sled elevation.

Another object of the invention was to equip the machine with protective safety shields to cover the major moving parts and to improve machine appearance.

A final objective of the invention was to structure the component geometry and arrange the power transfer elements in such a manner as to accommodate the limited space and location parameters imposed by a foldable frame.

DESCRIPTION OF THE DRAWINGS

In FIG. 3A, the machine is shown in the at rest position, with phantom line representations of the folded standard and the swing bar. In FIG. 3B, the machine is shown at a point of elevation, permitting analysis of the kinematics involved in the movement from the position of FIG. 3A to that of 3B.

FIG. 5A illustrates the machine at a point of origin, introductory to elevation of the sled, as shown in FIG. 5B. FIG. 5B also illustrates, with solid and phantom line representations, two body positions that a user might assume to achieve sled elevation. Such posture changes are causal to the activation of separate muscle groups.

FIG. 6A illustrates the machine at a point of origin, while 6B shows the sled in an elevated position and offers solid and phantom line representations of the user in two selected body postures.

PREFERRED EMBODIMENT OF THE INVENTION

Figure 1:
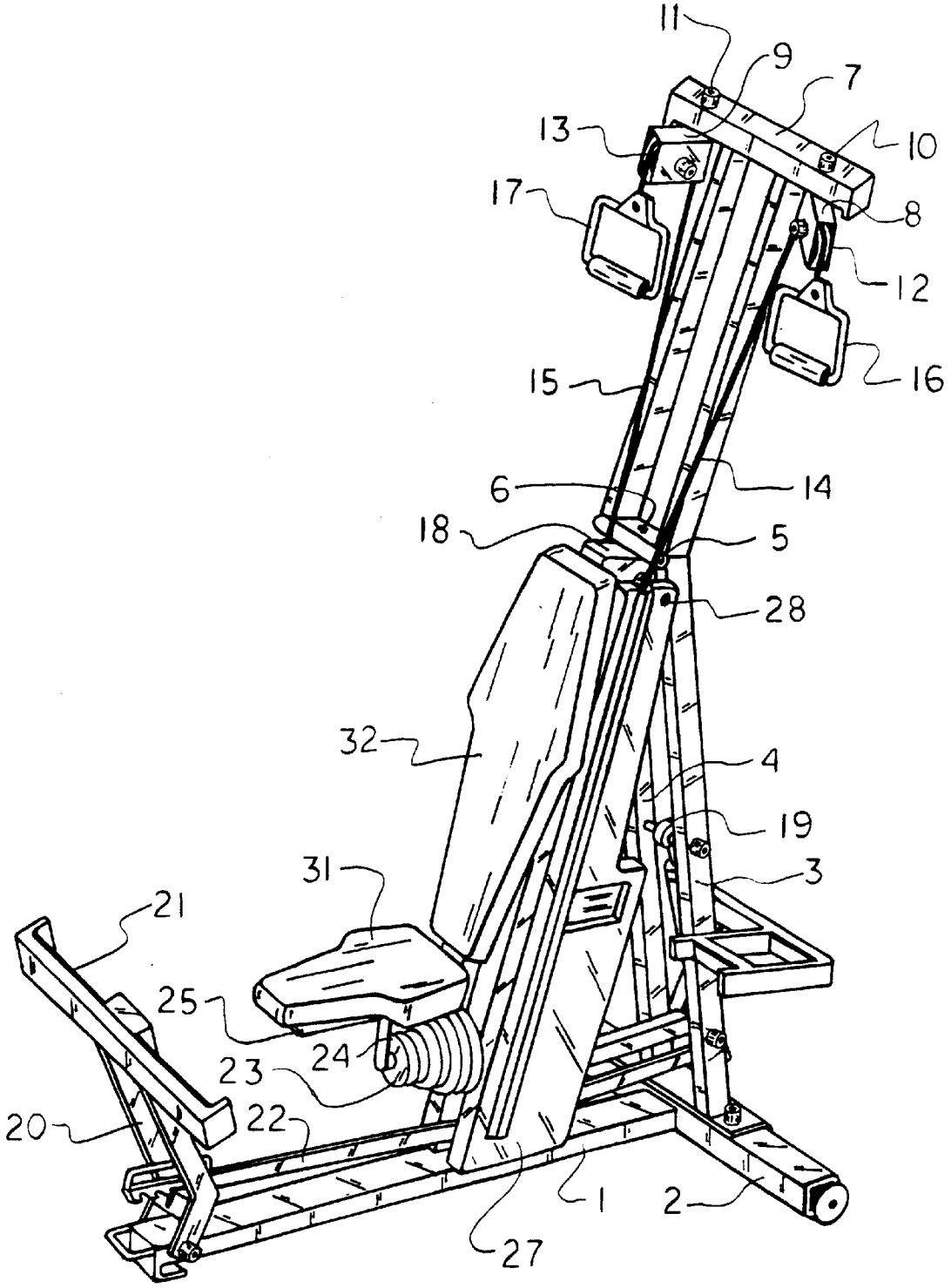
FIG. 1 is a perspective assembly drawing illustrating the configuration and relationship of visible components of the fitness sled.

In the disclosure to follow, all specialty hardware items are identified. Common hardware that is shown, but not numbered is of standard grade and availabilty in off the shelf hardware outlets. FIG. 1 provides a dimensional view of the fitness sled that best depicts the configuration of externally visible components of the specified exercise machine. Shown in assembly perspective is a longitudinal base frame 1, with a front end and a rear end, the later with a crossbar 2, that mechanically supports standard members 3 and 4. Those members are divided by hinge 5 into two sections, a fixed lower section, and a foldable upper section. The folding nature of the standard is illustrated in FIG. 3-A, which provides a phantom line representation of the lowered standard, collapsed to reduce shipping costs. When vertically inclined, in the operating position, the upper section is locked in place with a fastener at point 6, of FIG. 1. In that figure, the upper section of the standard supports a header bar 7, which in turn suspends swivel pulley housings 8 and 9 with shoulder bolts 10 and 11. The swivel housings axially contain pulleys 12 and 13, that carry lines 14 and 15, which attach at their end points to handrings 16 and 17.

Other parts identified in FIG. 1, that are fully or partially visible include: a fixed location pulley housing 18, mounted between the standard members 3 and 4, at a point just below hinge 5, and a hydraulic cylinder 19, that is pivotally secured between the standard members 3 and 4. Also, identified in FIG. 1, is leg lever 20, supporting a frontal foot bar 21, a draw bar 22, and a weight stack 23, with swing bar 24. The swing bar is pivotally mounted to the sled frame 25. The action of that bar, to receive weightedness, is illustrated in the phantom line representation of FIG. 3-A. When closed the swing bar sleeves over the open end of weight bar 26 to stabilize that mass. Panel 27 of FIG. 1 serves as a safety shield for moving parts and is joined to the fixed standard member, at a top location, with a stud fastener 28. At its bottom peripheral surface, the shield is held in place, bayonet fashion, by two rods 29 and 30, shown in FIG. 2, that protrude through holes in the shield. Seat 31 with backrest 32 is fitted to receive either a front or rear facing user and is attached to the sled frame 25 with T-nut fasteners placed at strategic locations exemplified by typical location point 33 of FIG. 2.

Figure 2:
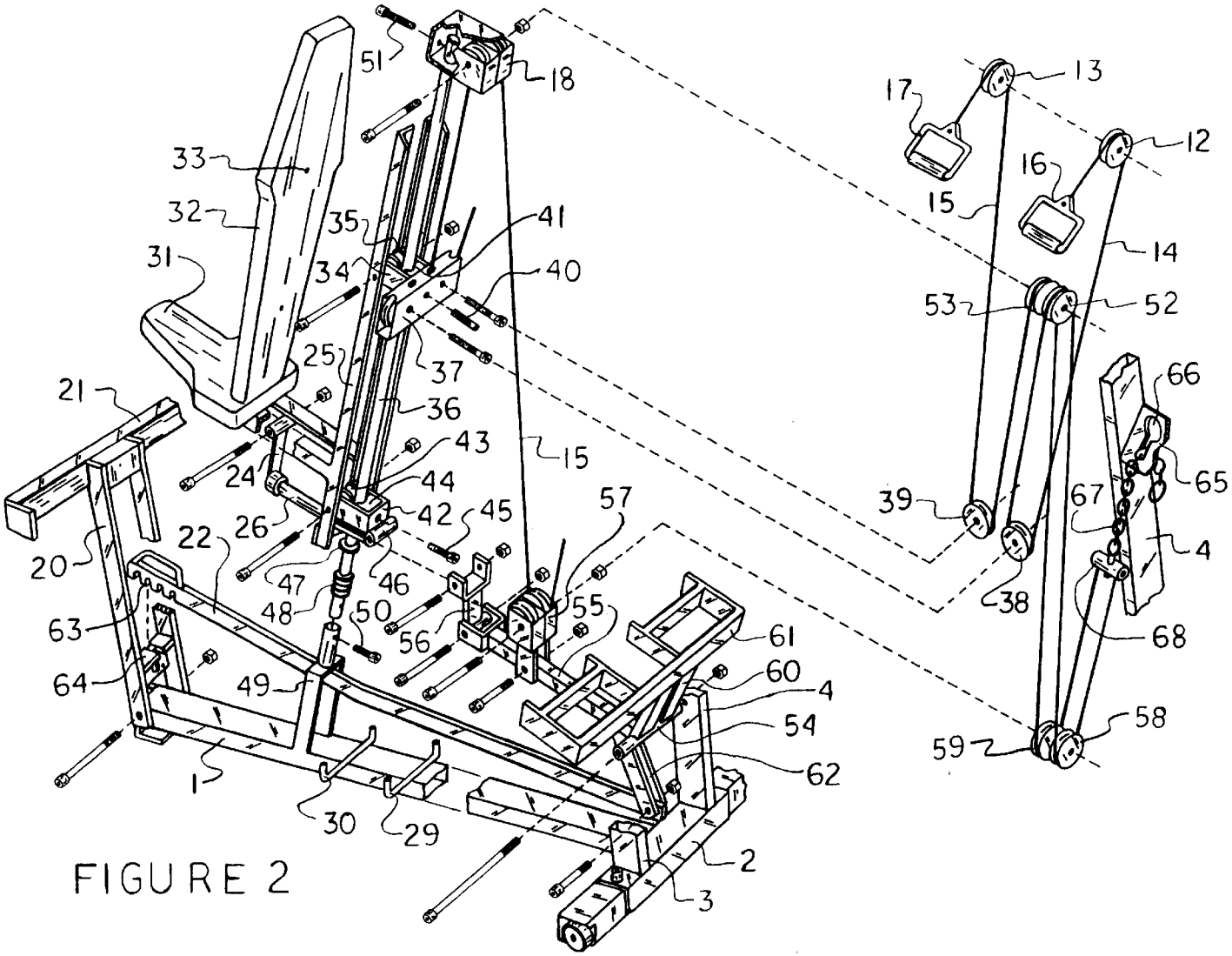
FIG. 2 is a perspective drawing with exploded and cutaway features for further identification of hidden structure. This drawing also provides a revolved, skeletal view of the pulley and line lift components, removed from their housing structures, to indicate the geometry associated with that assembly.

FIG. 2 presents a partially exploded illustration of the mechanical elements of the fitness sled together with a revolved view of the pulley and line lift assembly that describes the geometry of that assembly. In that figure, sled frame 25 is shown to have two longitudinally spaced housings that contain tracking assemblies. An upper housing 34, radially supports a concave faced wheel 35 to track on the front surface of a cylindrical rail 36. Housing 34 is faced with a pulley chamber 37, which contains tandemly arranged pulleys 38 and 39, shown in the revolved view of the pulley assembly of FIG. 2. Chamber 37 also receives, in threaded contact, a ball nosed machine screw 40, that adjusts the tension on a wear compensating follow block 41, that bears on the back surface of rail 36. That block also stabilizes the lateral motion of the sled as it traverses the rail. The lower pulley housing 42, of sled frame 25, has structure similar to the upper housing. It axially contains a concave faced wheel 43, and a follow block 44. At its rear surface, this housing is fitted to receive a ball nosed adjusting screw 45, and to support a coupling cylinder 46.

Below housing 42, the rail 36 penetrates a washer 47 and compression spring 48, to enter a tubular section of a bridge fixture 49, wherein it is secured to the base frame 1 with a socket headed set screw 50. Spring 48 serves as a sled stop and cushions the return of the body sled to its at rest position. At its top end, rail 36 is contained within the dual chambered pulley housing 18, shown attached to the fixed standard members 3 and 4 in FIG. 1. A socket head setscrew 51, joins the rail to the housing, which also carries two fixed location pulleys 52 and 53, shown in the revolved pulley and line lift assembly diagram of FIG. 2.

Also shown in FIG. 2, is a trifurcated lever with a hub 54 at the juncture of its three branch extensions. The lever pivots on the hub between the spaced standard members 3 and 4. A first extension 55, of the lever is pivotally joined, at its end point, to the sled coupling cylinder 46, with connecting arm 56. The connecting arm transfers the radial motion of the trifurcated lever to the lineal motion required in sled travel. Also, pivotally mounted near the end of extension 55, is a dual pulley housing 57, of the lift assembly. Housing 57 axially retains pulleys 58 and 59, shown in the revolved pulley diagram of FIG. 2.

A second extension 60, of the trifucated lever, has two longitudinal members spaced to receive cylinder hardware discussed in a later section. At the upper end of extension 60, is mounted a pair of joined foot bars 61, that extend laterally to each side of the machine in such a manner as to accommodate variable leg extensions. Thus, one bar is located at a greater distance from a rear facing user than the other. The footbars serve to transmit leg force from the user to the trifucated lever and its operative components.

A third extension 62, of the trifucated lever, has two separated bars to receive, in pivotal union therebetween, one end of the drawbar 22. Said drawbar proceeds forward under the bridge fixture 49, to its other end where one of a series of notches 63, cut in the drawbar, engage in pivotal union with a pinion bar 64, attached to the leg lever 20. The selection of different notches, for engagement, adjusts the position of the footbar 21, to accommodate variability in individual leg lengths.

The revolved diagram shown in FIG. 2 was provided to indicate the geometry associated with the pulley and line lift assembly. It serves to identify the pulley positions and their alignment when removed from their respective support structure. Essentially the system employs two sets of stationary position pulleys and two sets of movable position pulleys. In the diagram of FIG. 2, a portion of the standard member 4 is shown supporting an anchor plate 65, with a keyhole opening 66, to receive a length of link chain 67. The chain, in turn, is connected to a swivel coupler 68, which is attached to the lines 14 and 15 to maintain their alignment. From the anchor, both lines descend to circumscribe pulleys 58 and 59 which reside within pulley housing 57. Departing from the pulleys 58 and 59, the lines proceed upward to encircle a set of dual pulleys 52 and 53, that normally reside within the fixed location housing 18. Housing 18 was shown in FIG. 1 to be attached to the fixed standard members 3 and 4. Leaving the pulleys 52 and 53, the lines once again move downward to pass under tandem pulleys 38 and 39 of the sled frame pulley chamber 37. Emerging from those pulleys, the lines 14 and 15 pass over the pulleys 12 and 13 of the header bar 7, and descend to join the handrings 16 and 17. It may observed that the the chain has a number of links, any one of which may be joined to the anchor plate, and that the position of the chain determines the ultimate position of the handrings, thusly effecting adjust to meet variables in the user's arm extension.

Figures 3A, 3B, 4:
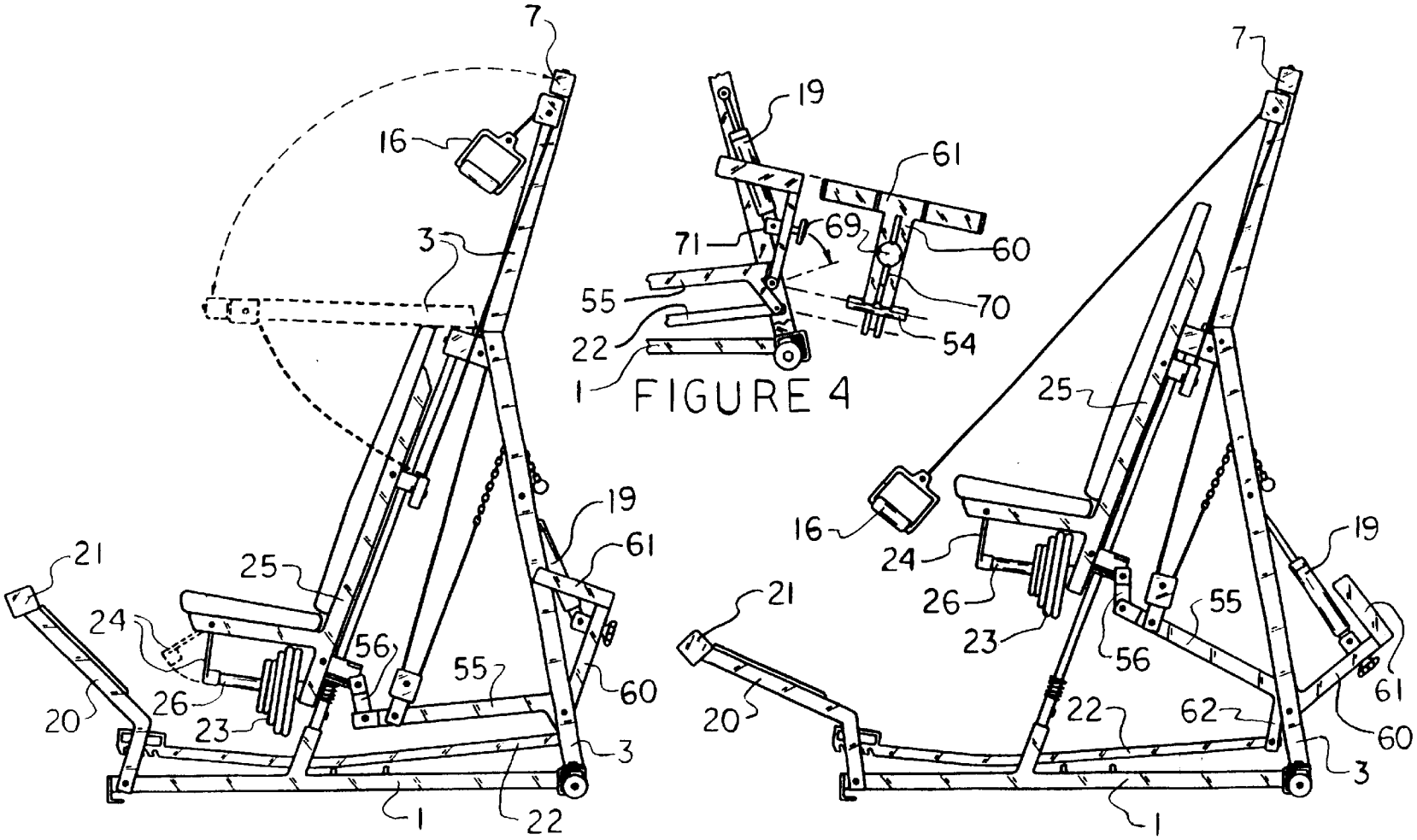
FIGS. 3A and 3B offer sequential, right side profile views of the machine.
FIG. 4 is a partial, orthographic drawing of the hydraulic cylinder, illustating the support structure attendant to the cylinder's adjustment, and to its function as a variable resistance force.

FIGS. 3A and 3B illustrate the rise of the sled from the at rest position in FIG. 3A, to its maximum elevation in FIG. 3B. That transition indicates the effect of elevation on the positions of the foot bars 21 and 61, line payout to the rings 16, and the extension of the hydraulic cylinder 19. Each of those entities enterconnected by the three extensions 55, 60, and 62,of the trifucated lever, and activated by the pulley and line lift assembly. The action of the hydraulic cylinder 19, is such that it opposes movement during the extension of its stroke only, thereby providing resistance to elevation that is supplemental to body weight and to the addition of weights to the support bar 26. Further information regarding the work of this cylinder is provided in FIG. 4, which illustrates a profile view of the cylinder and its companion structure. In FIG. 4, it is shown that the position of the cylinder may be changed by adjusting a handscrew 69, the stem of which penetrates an elongated slot 70, of the trifurcated lever extension 60, to engage a threaded cylinder base bracket 71. When the bracket is locked at the bottom of the slot, the cylinder's stroke is nearly static and resistance is minimal. Adjusting the cylinder bracket upward in the slot lengthens the stroke and increases resistance. Thus, the adjustment of stroke length provides variable resistance when the cylinder itself does not have pressure adjustments.

Figure 5A:
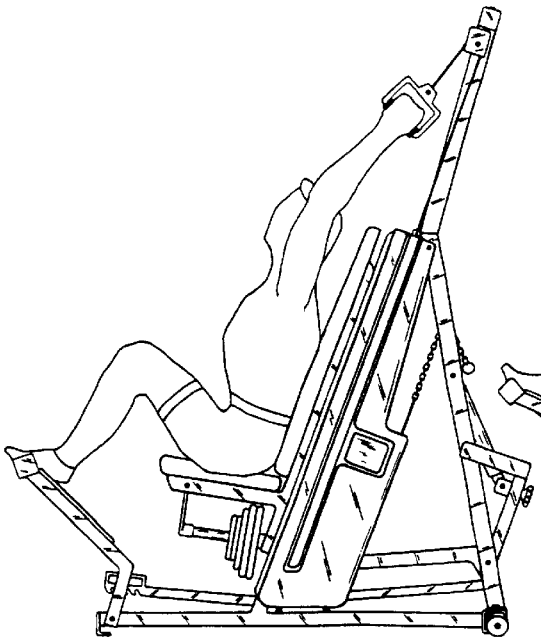
FIGS. 5A and 5B are sequential, right side profile drawings of a male user in the front facing exercise position.
Figure 5B:
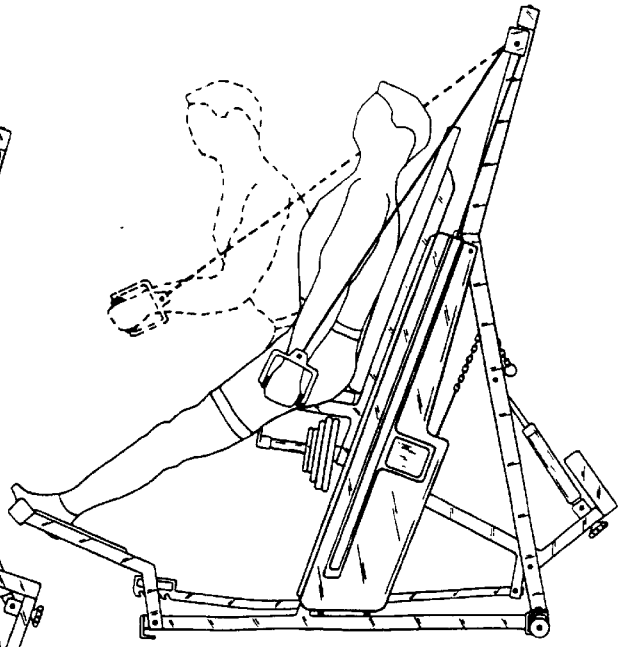
Figure 6A:
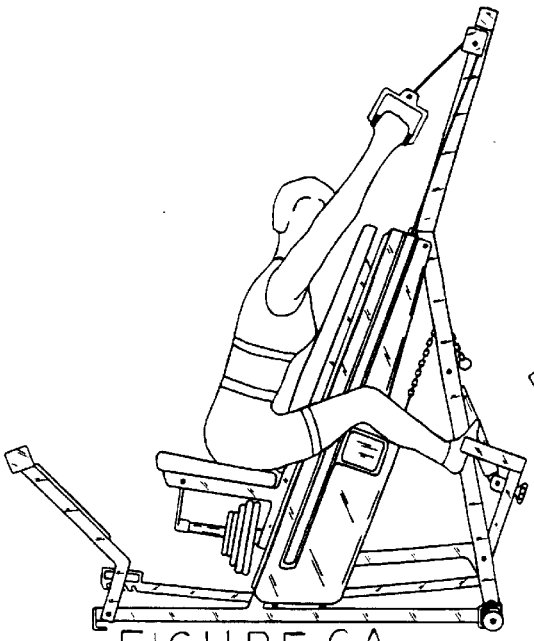
FIGS. 6A and 6B are sequential, right side profile drawings of a female user in the rear facing exercise position.
Figure 6B:
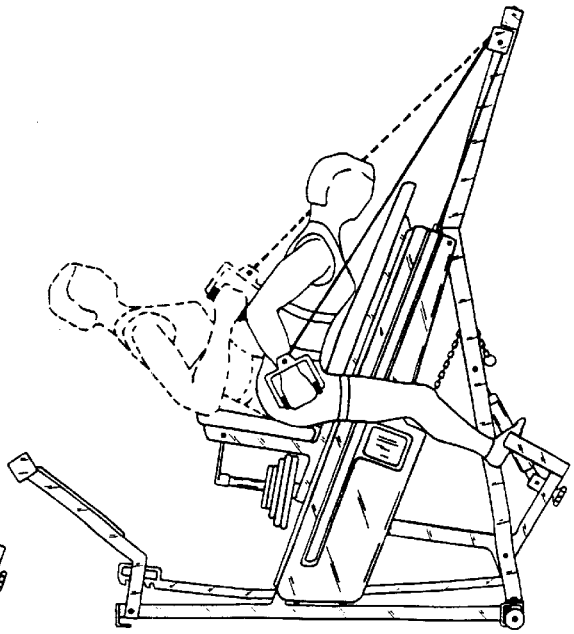

FIGS. 5A, 5B, 6A, and 6B illustrate the biomechanical interface of the user and machine. In FIGS. 5A and 5B, a forward facing machine user employs arm and leg force to elevate the body sled. FIG. 5A, illustrates the machine in an at rest position and FIG. 5B, indicates two of several body positions available to the user in achieving elevation of the sled. Each of the alternate positions shown activates a somewhat different muscle or subset of muscle groups. For example, the forward leaning, phantom line stance of the user in FIG. 5B, works the pectoralis muscles to a greater extent than does the solid line representation of that figure, which emphasizes the latissimus muscle group. In FIGS. 6A and 6B, a female user is in the rear facing exercise position, and again, it may be noted, that at the height of the elevation cycle, the user employs alternate body positions. In the solid line silhouette, the triceps are the focus of the exercise, while the phantom line representation emphasizes work on the biceps, deltoid and abdominal muscle groups. A major advantage of the line and handring assembly, is that it offers flexible path exercises for the upper body.

What is claimed is:

1. A fitness sled exercise machine comprising:

a frame;

an inclined rail attached to the frame;

a body support sled slidably engaging the inclined track and including a seat for supporting a user and a means for supporting weights;

a trifurcated power lever pivotally attached to the frame, an extension of the power lever being operatively connected to the sled to lift the sled in response to movement of the power lever;

a hydraulic cylinder operatively connected to an extension of the power lever to oppose movement of the power lever;

a pulley and line lift apparatus operatively connected to an extension of the power lever for manipulation by a seated user's arms to move the power lever and lift the sled along the inclined rail; and a leg lever pivotally connected to the frame and operatively connected to an extension of the power lever for manipulation by a seated user to move the power lever and lift the sled along the inclined rail.

2. The exercise machine of claim 1, wherein the frame includes a standard which joins the inclined rail at an upper portion thereof.

3. The exercise machine of claim 2, wherein the standard is foldable for shipment.

4. The exercise machine of claim 1, wherein the pulley and line lift apparatus includes a pair of lines engaging a pair of pulleys supported by a header bar on an upper portion of the frame, above the inclined rail.

5. The exercise machine of claim 1, wherein the pulley and line lift apparatus includes a pair of lines each having one end anchored on the frame, an intermediate portion engaging a pulley attached to an extension of the power lever and a pulley on an upper portion of the frame, and an opposite end having a hand grip.

6. The exercise machine of claim 1, wherein the pulley and line lift apparatus includes a pair of lines each having one end anchored on the frame, an intermediate portion engaging, in turn, a pulley attached to an extension of the power lever, a pulley on an upper end of the rail, a pulley attached to the sled, and a pulley attached to an upper portion of the frame, and an opposite end having a hand grip.

7. The exercise machine of claim 1, further comprising a housing for shielding moving parts of the machine.

8. The exercise machine of claim 1, wherein the pulley and line lift apparatus includes a line having one end anchored to the frame.

9. The exercise machine of claim 8, wherein the anchored end of the line is attached to a chain which is adjustably anchored in a keyhole opening on the frame.

10. The exercise machine of claim 1, wherein the trifurcated power lever pivots on an axis at the juncture of three branch extensions.

11. The exercise machine of claim 1, wherein one extension of the trifurcated power lever is pivotally joined to the sled by a connecting arm and further supports a pulley of the pulley and line lifting apparatus.

12. The exercise machine of claim 1, wherein one extension of the trifurcated power lever is attached to an end of the hydraulic cylinder and further supports a pair of foot rests.

13. The exercise machine of claim 1, wherein one extension of the trifurcated power lever is connected to the leg lever by an adjustable length drawbar.

14. The exercise machine of claim 1, further comprising means for adjustably regulating the stroke of the hydraulic cylinder.

15. The exercise machine of claim 14, wherein said adjusting mens comprises a hand screw.

16. The exercise machine of claim 1, wherein the trifurcated power lever pivots on an axis at the juncture of three branch extensions; a first extension of the trifurcated power lever being pivotally joined to the sled by a connecting arm and further supporting a pulley of the pulley and line lifting apparatus; a second extension of the trifurcated power lever being attached to an end of the hydraulic cylinder and further supporting a pair of foot rests; and a third extension of the trifurcated power lever being connected to the leg lever by an adjustable length drawbar.

17. The exercise machine of claim 1, wherein the weight support means comprises a bar for receiving a standard circular weight.

18. The exercise machine of claim 17, wherein the bar is stabilized with a swing bar that is pivotally attached to the sled.

19. The exercise machine of claim 17, wherein the bar is attached to the frame at a point below the seat.

20. The exercise machine of claim 1, wherein the seat is fitted to receive a front- or rear-facing user.

* * * * *